US008210380B2

(12) United States Patent
Jin et al.

(10) Patent No.: US 8,210,380 B2
(45) Date of Patent: Jul. 3, 2012

(54) DUSTBIN OF ADJUSTABLE HEIGHT

(75) Inventors: Jiaming Jin, Zhejiang (CN); Xiaofeng Lu, Zhejiang (CN); Jinxin Wu, Zhejiang (CN)

(73) Assignee: Zhejiang Jiaxing Zhongda Group Co., Ltd., Baibu Town, Haiyan, Zhejiang Province (CN)

( * ) Notice: Subject to any disclaimer, the term of this patent is extended or adjusted under 35 U.S.C. 154(b) by 127 days.

(21) Appl. No.: 12/782,048

(22) Filed: May 18, 2010

(65) Prior Publication Data

US 2011/0139789 A1 Jun. 16, 2011

(30) Foreign Application Priority Data

Dec. 10, 2009 (CN) ..... 2009 2 0291684 U

(51) Int. Cl.
*B65D 21/02* (2006.01)

(52) U.S. Cl. . 220/23.87; 220/8; 220/23.89; 220/495.06; 220/505; 220/629; 206/761; 73/429

(58) Field of Classification Search ..... 220/8, 23.87, 220/23.89, 495.06, 505, 629; 206/761; 73/429
See application file for complete search history.

(56) References Cited

U.S. PATENT DOCUMENTS 1,015,455 A * 1/1912 Neesham ..... 220/8
6,644,493 B1 * 11/2003 Walton et al. ..... 220/603

* cited by examiner

*Primary Examiner* — Anthony Stashick
*Assistant Examiner* — Elizabeth Volz
(74) *Attorney, Agent, or Firm* — Global IP Services; Tianhua Gu

(57) ABSTRACT

A dustbin with an adjustable height comprises an outside container body, an inside container body, a compression spring provided between the bottom of outside container body and the bottom of inside container body, a longitudinal row of grooves provided at the side wall of the inside container body and a level regulator provided at the side wall of the outside container body. The level regulator has a left end for embedding in the groove and a right end for coupling with a switch means to control the horizontal motion of the level regulator. The height of inside container body can be adjusted to satisfy the users of different heights by the level regulator.

3 Claims, 2 Drawing Sheets

DUSTBIN OF ADJUSTABLE HEIGHT

CROSS REFERENCE TO THE RELATED PATENT APPLICATIONS

This patent application claims the priority of the Chinese patent application No. 200920291684.X filed on Dec. 10, 2009, which application is incorporated herein by reference.

BACKGROUND OF THE INVENTION

1. Field of the Invention

The present invention relates to a dustbin.

2. Related Prior Art

In prior art, a dustbin is not provided with a means to adjust its height. So, the height of dustbin is unchangeable. However for people of different heights, such as adults or kids, the height required for the dustbin is different. Therefore, a dustbin of unchangeable height cannot meet the needs by people of different heights.

SUMMARY OF THE INVENTION

Accordingly, the present invention has been keeping in mind the above problem occurring in the related art, and the object of the present invention is to provide a dustbin of adjustable height to meet the needs by users of different heights.

A dustbin of adjustable height comprises:

an outside container body (2) and an inside container body (1);

a compression spring (3) provided between a bottom (22) of the outside container body (2) and a bottom (12) of the inside container body (1);

a plurality of grooves provided at a side wall (11) of the inside container body (1) along a longitudinal direction;

a level regulator (5) provided at a side wall (21) of the outside container body (2), with its left end embeds in the groove (4) and its right end couples with a switch means to control a horizontal motion of the level regulator (5).

Before adjusting the height, the inside container body (1) compresses the compression spring (3), the level regulator (5) catches in the groove (4), and the inside container body (1) is in a balanced state; when adjusting the height, the switch means will bring the level regulator (5) to move rightwards, i.e. the level regulator (5) moves out of the original groove (4) and the inside container body (1) moves upwards to a desired height, then the switch means will bring the level regulator (5) to move leftwards, i.e. the level regulator (5) moves into another groove (4) and the inside container body (1) is again in a balanced state, thus completing the height adjustment for the dustbin.

The above-mentioned switch means comprises:

a bracket (61) mounted on the side wall (21) of outside container body (2) consisting of a horizontal supporting plate (611) and a vertical supporting plate (612), the horizontal supporting plate (611) vertically fixed onto the side wall (21) of outside container body (2) and the vertical supporting plate (612) fixed onto the horizontal supporting plate (611), a horizontal lever (62) across the side wall (21) of outside container body (2), with its left end connected to the level regulator (5), a compression spring (63) provided between the right end of the horizontal lever (62) and the vertical supporting plate (612), a slot (621) provided at the right end of the horizontal lever (62) and an edge (622) provided at the right side of the slot (621), a longitudinal lever (64) across the horizontal supporting plate (611), the upper end of the longitudinal lever (64) fixedly connecting a manual button (65), a compression spring (66) provided around the portion of longitudinal lever (64) between the manual button (65) and the horizontal supporting plate (611), the lower end of longitudinal lever (64) inserting in the slot (621) of horizontal lever (62) and having a bevel (641) contacting the edge (622) of horizontal lever (62); when pressing the manual button (65), the bevel (641) will move downwards and drive the edge (622) to move rightwards, so that the horizontal lever (62) will also move rightwards, and the level regulator (5) will detach off the groove (4) and be lifted under the role of compression spring (3).

When pressing the manual button (65) to adjust the height, the longitudinal lever (64) will move downwards, the bevel (641) will drive the edge (622) to move rightwards, so that the horizontal lever (62) will be brought to move rightwards, the level regulator (5) will consequently move rightwards and detach off the groove (4), and the inside container body (1) will move upwards under the elasticity of compression spring (3).

When lifting to a desired height, loosen the manual button (65). The longitudinal lever (64) will move upwards under the elasticity of compression spring (66), the bevel (641) will no longer drive the edge (622) and the horizontal lever (62) will be brought to move leftwards under the elasticity of compression spring (63) and catch in another groove (4) again to restore the original state of balance of the inside container body (1), thus completing the adjustment of dustbin height.

A revolving shaft (53) is provided on the horizontal lever (62). The level regulator (5) is a roller provided on the revolving shaft (53).

The roller rolls in the groove (4) to ensure more stable motion of inside container body (1) in the course of height adjusting.

A flange (13) is provided at the top of inside container body (1), covering the top of side wall (21) of outside container body (2). A limitation step (14) is provided at the lower end of groove (4).

The flange (13) is designed to effectively prevent the inside container body (1) from completely immersing in the outside container body (2). The limitation step (14) is designed to effectively prevent the inside container body (1) from completely ejecting out of the outside container body (2).

According to the present invention, the level regulator (5) catches in the groove (4) at different heights so that the inside container body (1) can project the outside container body (2). The height of inside container body (1) can be adjusted to satisfy the users of different heights. The operation is very simple: to adjust the height, just press the manual button (65) of the switch means.

DETAIL DESCRIPTION OF THE INVENTION

Figure 1:
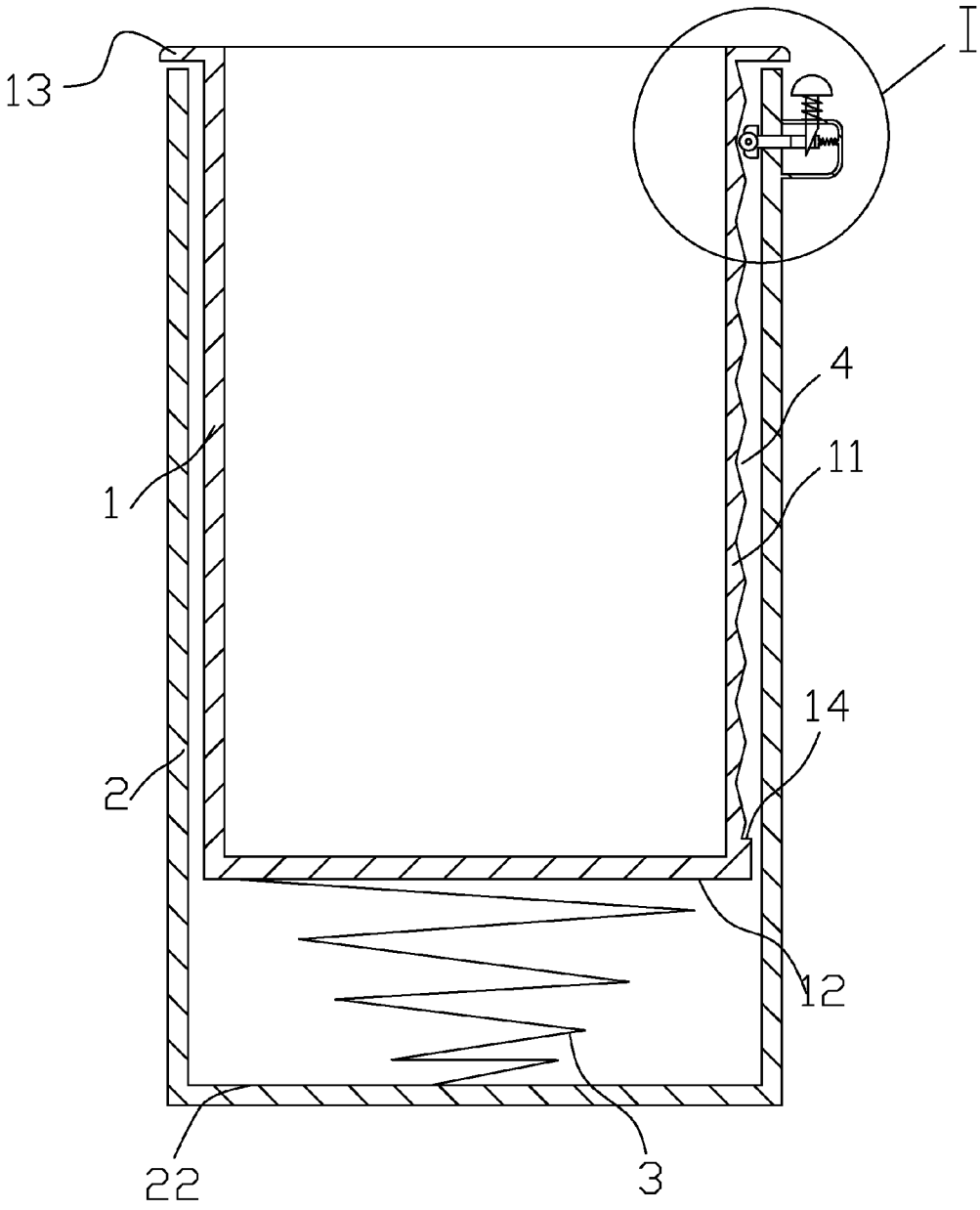
FIG. 1 is the schematic view of structure of the embodiment in present invention.

The preferred embodiment of the present invention will now be described with reference to FIGS. 1-3 of the drawings. Identical elements in the various figures are identified with the same reference numerals.

Embodiment 1

Figure 2:
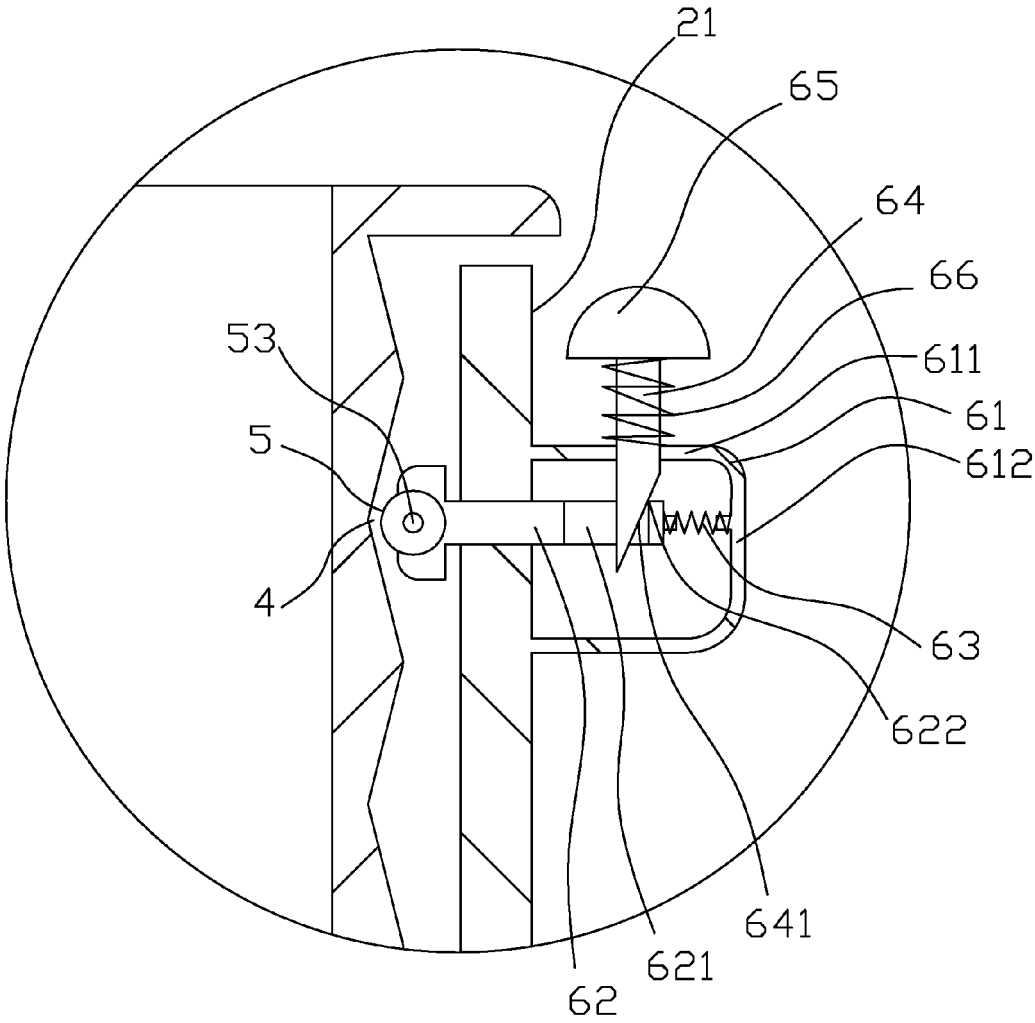
FIG. 2 is an enlarged view of Portion I in FIG. 1.
Figure 3:
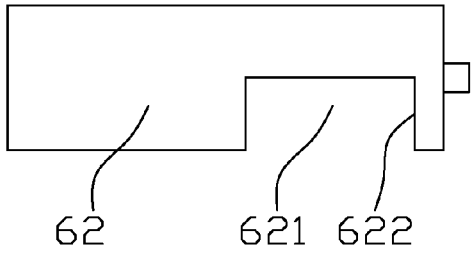
FIG. 3 is the schematic view of horizontal lever in FIG. 2.

A dustbin of adjustable height as shown in FIG. 1 to FIG. 3 comprises an outside container body (2) and an inside container body (1), a compression spring (3) provided between the bottom (22) of outside container body (2) and the bottom (12) of inside container body (1), a longitudinal row of grooves provided at the side wall (11) of inside container body (1), a level regulator (5) provided at the side wall (21) of outside container body (2), with its left end embeds in the groove (4) and its right end coupling with a switch means to control the horizontal motion of the level regulator (5).

Before adjusting the height, the inside container body (1) compresses the compression spring (3), the level regulator (5) catches in the groove (4), and the inside container body (1) is in a balanced state; when adjusting the height, the switch means will bring the level regulator (5) to move rightwards, i.e. the level regulator (5) moves out of the original groove (4) and the inside container body (1) moves upwards to a desired height, then the switch means will bring the level regulator (5) to move leftwards, i.e. the level regulator (5) moves into another groove (4) and the inside container body (1) is again in a balanced state, thus completing the height adjustment for the dustbin.

The above-mentioned switch means comprises: a bracket (61) mounted on the side wall (21) of outside container body (2) consisting of a horizontal supporting plate (611) and a vertical supporting plate (612), the horizontal supporting plate (611) vertically fixed onto the side wall (21) of outside container body (2) and the vertical supporting plate (612) fixed onto the horizontal supporting plate (611), a horizontal lever (62) across the side wall (21) of outside container body (2), with its left end connected to the level regulator (5), a compression spring (63) provided between the right end of the horizontal lever (62) and the vertical supporting plate (612), a slot (621) provided at the right end of the horizontal lever (62) and an edge (622) provided at the right side of the slot (621), a longitudinal lever (64) across the horizontal supporting plate (611), the upper end of the longitudinal lever (64) fixedly connecting a manual button (65), a compression spring (66) provided around the portion of longitudinal lever (64) between the manual button (65) and the horizontal supporting plate (611), the lower end of longitudinal lever (64) inserting in the slot (621) of horizontal lever (62) and having a bevel (641) contacting the edge (622) of horizontal lever (62); when pressing the manual button (65), the bevel (641) will move downwards and drive the edge (622) to move rightwards, so that the horizontal lever (62) will also move rightwards, and the level regulator (5) will detach off the groove (4) and be lifted under the role of compression spring (3).

When pressing the manual button (65) to adjust the height, the longitudinal lever (64) will move downwards, the bevel (641) will drive the edge (622) to move rightwards, so that the horizontal lever (62) will be brought to move rightwards, the level regulator (5) will consequently move rightwards and detach off the groove (4), and the inside container body (1) will move upwards under the elasticity of compression spring (3). When lifting to a desired height, loosen the manual button (65). The longitudinal lever (64) will move upwards under the elasticity of compression spring (66), the bevel (641) will no longer drive the edge (622) and the horizontal lever (62) will be brought to move leftwards under the elasticity of compression spring (63) and catch in another groove (4) again to restore the original state of balance of the inside container body (1), thus completing the adjustment of dustbin height.

A revolving shaft (53) is provided on the horizontal lever (62). The level regulator (5) is a roller provided on the revolving shaft (53).

The roller rolls in the groove (4) to ensure more stable motion of inside container body (1) in the course of height adjusting.

A flange (13) is provided at the top of inside container body (1), covering the top of side wall (21) of outside container body (2). A limitation step (14) is provided at the lower end of groove (4).

The flange (13) is designed to effectively prevent the inside container body (1) from completely immersing in the outside container body (2). The limitation step (14) is designed to effectively prevent the inside container body (1) from completely ejecting out of the outside container body (2).

What is claimed is:

1. A dustbin of adjustable height comprising:

an outside container body (2) and an inside container body (1);

a compression spring (3) provided between a bottom (22) of the outside container body (2) and a bottom (12) of the inside container body (1);

a plurality of grooves provided at a side wall (11) of the inside container body (1) along a longitudinal direction;

a level regulator (5) provided at a side wall (21) of the outside container body (2), with its left end embedded in the groove (4) and its right end coupled with a switch means to control a horizontal motion of the level regulator (5);

the switch means comprising:

a bracket (61) mounted on the side wall (21) of the outside container body (2), which comprises a horizontal supporting plate (611) and a vertical supporting plate (612), the horizontal supporting plate (611) is vertically fixed onto the side wall (21) of the outside container body (2) and the vertical supporting plate (612) is fixed onto the horizontal supporting plate (611);

a horizontal lever (62) across the side wall (21) of the outside container body (2), with its left end connected to the level regulator (5), a compression spring (63) is provided between a right end of the horizontal lever (62) and the vertical supporting plate (612), a slot (621) is provided at a right end of the horizontal lever (62) and an edge (622) is provided at the right side of the slot (621);

a longitudinal lever (64) with its upper end connected to a manual button (65), a compression spring (66) is provided on the longitudinal lever (64) between the manual button (65) and the horizontal supporting plate (611), a lower end of the longitudinal lever (64) is inserted in the slot (621) of horizontal lever (62) and has a bevel (641) contacting the edge (622) of horizontal lever (62), when pressing the manual button (65), the bevel (641) is moved downwards to push the edge (622) moving rightwards, thereby the horizontal lever (62) moves rightwards, the level regulator (5) detaches off the groove (4) and the inside container body (1) is pushed up under a role of the compression spring (3).

2. The dustbin of adjustable height of claim 1, wherein a shaft (53) is provided on the horizontal lever (62), the level regulator (5) has a roller that is provided on the shaft (53).

3. The dustbin of adjustable height of claim 1, wherein a flange (13) is provided at a top of the inside container body (1), the flange (13) sits on a top of the side wall (21) of the outside container body (2), a limitation step (14) is provided at the lowest one of the plurality of grooves (4).

* * * * *